United States Patent [19]

Blackmer et al.

[11] Patent Number: 4,589,129

[45] Date of Patent: May 13, 1986

[54] SIGNAL DECODING SYSTEM

[75] Inventors: David E. Blackmer, Wilton, N.H.; James H. Townsend, Jr., Cambridge, Mass.

[73] Assignee: Kintek, Inc., Waltham, Mass.

[21] Appl. No.: 581,660

[22] Filed: Feb. 21, 1984

[51] Int. Cl.[4] ..... H04R 5/00

[52] U.S. Cl. ..... 381/21; 381/18

[58] Field of Search ..... 381/1, 17–22

[56] References Cited

U.S. PATENT DOCUMENTS 3,772,479 11/1973 Hilbert ..... 381/18

3,885,101 5/1975 Ito et al. ..... 381/18

4,121,059 10/1978 Nakabayashi ..... 381/1

4,139,728 2/1979 Haramoto et al. ..... 381/1

*Primary Examiner*—Forester W. Isen

*Attorney, Agent, or Firm*—Schiller & Pandiscio

[57] ABSTRACT

A signal decoding system for use in a quadraphonic type sound reproducing system is disclosed. In accordance with one aspect of the invention, a multiband expander is used to control the steering of the four information signals decoded from the two input signals. In accordance with another aspect of the invention, the difference between the rear and front signals is used to enhance virtual sound images to one side of a listener.

12 Claims, 8 Drawing Figures

SIGNAL DECODING SYSTEM

The present invention relates generally to sound reproducing systems. More particularly, the present invention relates to systems for decoding two input signals (containing audio data relating to virtual sound images) received on two corresponding input channels so as to produce at least four decoded information signals which are adapted to drive at least four loudspeakers positioned in a predisposed pattern with respect to a listener or audience so as to create virtual sound images at various locations around the listener.

As the term is used herein, "virtual sound image" means the apparent source of sound as psychoacoustically perceived by the listener that is created by the combination of sonic signals generated by the loudspeakers disposed in such predisposed patterns in response to the information signals.

Decoding systems of the type for generating at least four information signals from two input signals include quadraphonic sound systems. Quadraphonic sound systems have been realized based on the fact that sufficient audio data can be encoded in two input signals so that the two signals can be decoded into at least four unique information signals which in turn can be used to drive at least four loudspeakers disposed in a predisposed pattern around a listener so as to create virtual sound images. See, for example, U.S. Pat. Nos. 3,632,886; 3,944,735 and the references cited therein, including, respectively, U.S. Pat. Nos. 2,714,633; 2,845,491; 3,067,287; 3,067,292; 3,401,237 and 3,786,193; 3,794,781; 3,798,373; 3,812,295; 382,1471; 3,825,684; 3,829,615; 3,836,715.

One such quadraphonic system, described in U.S. Pat. No. 3632886, provides separation between the four output channels by simultaneously varying the gain in each of the channels of a diagonal pair. Diagonal channels are defined in this prior art system as the left and right output channels as one pair and the front and rear channels as the other pair (i.e., defined as each pair of loudspeakers which are considered on opposite sides of the listener). The prior art system provides that an increase in the gain in one pair of diagonal channels will be accompanied with a decrease in the gain in the other pair of diagonal channels so as to prevent a change in the overall volume of the audio output as a function of direction. As a consequence, only two of the four information signals are used to control the gain in all four output channels. Specifically, only the left and right output channels are detected, filtered, converted to their absolute value, with the two absolute value signals being then converted to their logarithmic value. The two log signals are then compared and the absolute value of the difference is averaged before being applied to a gain control generator. The generator provides the two control signals respectively to the voltage gain amplifiers of each diagonal pair of channels.

Better control, however, can be achieved by controlling the gain in each output channel with the signal transmitted in that channel. Further, by using a signal expander of the type using a level sensor for generating the control signal for controlling the signal gain of the information signal generated in the output channel greater dynamic range is achieved while improving the signal-to-noise ratio of the two input signals. Even better results can be achieved where multi-band expanders are used to control the signal gain of each information signal.

Accordingly, an object of the present invention is to provide a decoding system providing at least four information signals from two input signals containing audio data relating to virtual sound images, the signal gain of each information signal being controlled at least partly by the signal level of the information signal.

Another object of the present invention is to provide a decoding system providing at least four information signals from two input signals containing audio data relating to virtual sound images and including signal expanders for providing expansion for each information signal.

And another object of the present invention is to provide a decoding system for providing at least four information signals from two input signals containing audio data relating to virtual sound images and including multi-band expanders providing expansion for each information signal.

And yet another object of the present invention is to provide a decoding system providing at least four information signals from two input signals containing audio data relating to virtual sound images and using gain control signals for each channel derived from the detected level of the corresponding information signal in each such channel and the difference between the detected levels of the information signals in the diagonal pair of channels to which the information signal pertains.

These and other objects are achieved by an improved decoding system for use in a sound reproducing system and being of the type for coupling two input signals containing audio data to at least four loudspeakers, the latter being adapted to be positioned at different locations with respect to a listener. The decoding system comprises means responsive to the input signals for generating at least four electrical information signals corresponding to the loudspeakers and containing the audio data, the audio data of each signal being a function of the position of the respective loudspeaker relative to the listener, at least four electrical transmission paths for respectively transmitting the four information signals to the corresponding ones of the loudspeakers, means disposed in each of the transmission paths for impressing as a function of a control signal a signal gain on at least a portion of the information signal transmitted over each such path, and means coupled to each of the transmission paths for detecting the signal level of the portion of the information signal transmitted over each such path and for generating the control signal for each such path in response and as a function of the detected portion of the information signal.

With respect to another aspect of the present invention sound reproduction systems of the type described have been developed in which the rear quadraphonic signal is used with more than one speaker for creating a surround signal to create greater sound effects behind a listener.

It is another object of the present invention to provide an improved sound reproduction system of the type having at least a left and right surround loudspeaker and adapted to modify the left and right surround signals so as to enhance virtual sound images contained in the audio data of the information signals.

It is a more general object of the present invention to provide an improved sound reproduction system of the type utilizing at least two diagonal pair of information signals from a pair of input signals and adapted to modify one of the information signals of one diagonal pair when the other pair of diagonal signals indicate a clearly determined directionality so as to enhance the virtual sound image indicated by this predetermined directionality.

And another object of the present invention is to provide an improved sound reproduction system of the type having at least three channels, for convenience referred to as the right, left and center quadraphonic channels, and a rear surround channel for connection to at least left and right surround loudspeakers and adapted to enhance virtual sound images produced by the left or right surround loudspeakers when the signal energy in the left channel and right channel are different and the signal energy in the surround channel exceeds the signal energy in the front channel by a predetermined amount.

These and other objects are achieved by an improved system for decoding two input signals into at least four information signals (two diagonal pair) containing audio data relating to virtual sound images that can be created by the information signals when used to drive a plurality of loudspeakers predisposed in a preselected pattern relative to a listener. The system includes means for modifying one of the information signals of one diagonal pair (preferably the surround information signal) when the audio data of the other pair indicates a clearly determined directionality so as to enhance the virtual sound image indicated by the determined directionality.

Other objects of the invention will in part be obvious and will in part appear hereinafter. The invention accordingly comprises the apparatus possessing the construction, combination of elements and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawings wherein.

In the drawings, the same numerals are used to designate identical or similar parts.

Figure 1:
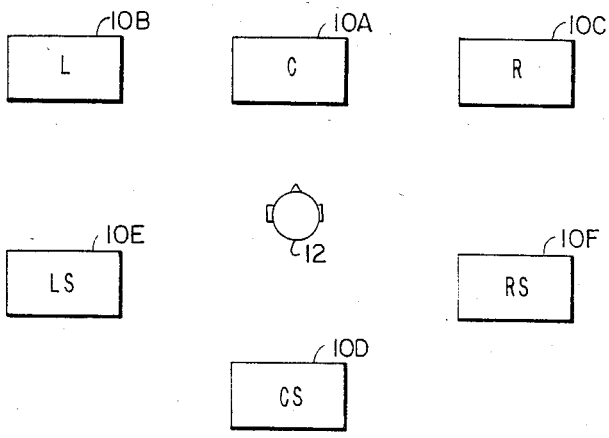
FIG. 1 is a simplified top view of a floor plan showing the predisposed pattern of the locations of six loudspeakers relative to a listener in the preferred embodiment of the present invention.

Referring to FIG. 1, the simplified top view of a floor plan shows the preferred predisposed pattern of the locations of six loudspeakers 10 relative to a listener 12 in the preferred embodiment of the present invention. The loudspeakers 10 are positioned so that loudspeaker 10A is positioned approximately in front of the listener, loudspeakers 10B and 10C are positioned in front of the listener respectively to the left and to the right of the center speaker 10A. The surround loudspeakers 10D, 10E and 10F are positioned so that loudspeaker 10D is positioned substantially directly behind the listener, while loudspeakers 10E and 10F are positioned behind and respectively to the left and right of the listener. In the preferred embodiment the loudspeakers are designed to be used with two encoded signals, one encoded with the L audio data and the other encoded with the R audio data. The left front loudspeaker 10B is adapted to be driven by left channel information signals containing only L audio data (contained in one of the input signals to the decoding system of the preferred embodiment of the present invention), while the right front loudspeaker is adapted to be driven by right channel information signals containing only R audio data (contained in the other of the input signals to the decoding system of the preferred embodiment of the present invention). The center front loudspeaker 10A is adapted to be driven by center information signals containing L+R audio data, provided by adding the left and right channel input signals; while the surround loudspeakers 10D, 10E and 10F are adapted to be driven by surround channel information signals containing L−R audio data provided by subtracting the right channel input signal from the left channel input signal. The left surround, right surround and center surround loudspeakers 10E, 10F and 10D, each receive different frequency and/or phase information from the surround channel information signal as will be more evident hereinafter. It will be evident that while only one speaker is shown as receiving each of the right, left and center channel information signals, and three speakers are shown receiving the surround channel information signal, the number of loudspeakers receiving the same information signal, or different phase and/or frequency information from the same information signal may vary, depending upon how the audio data are originally encoded.

Figure 2:
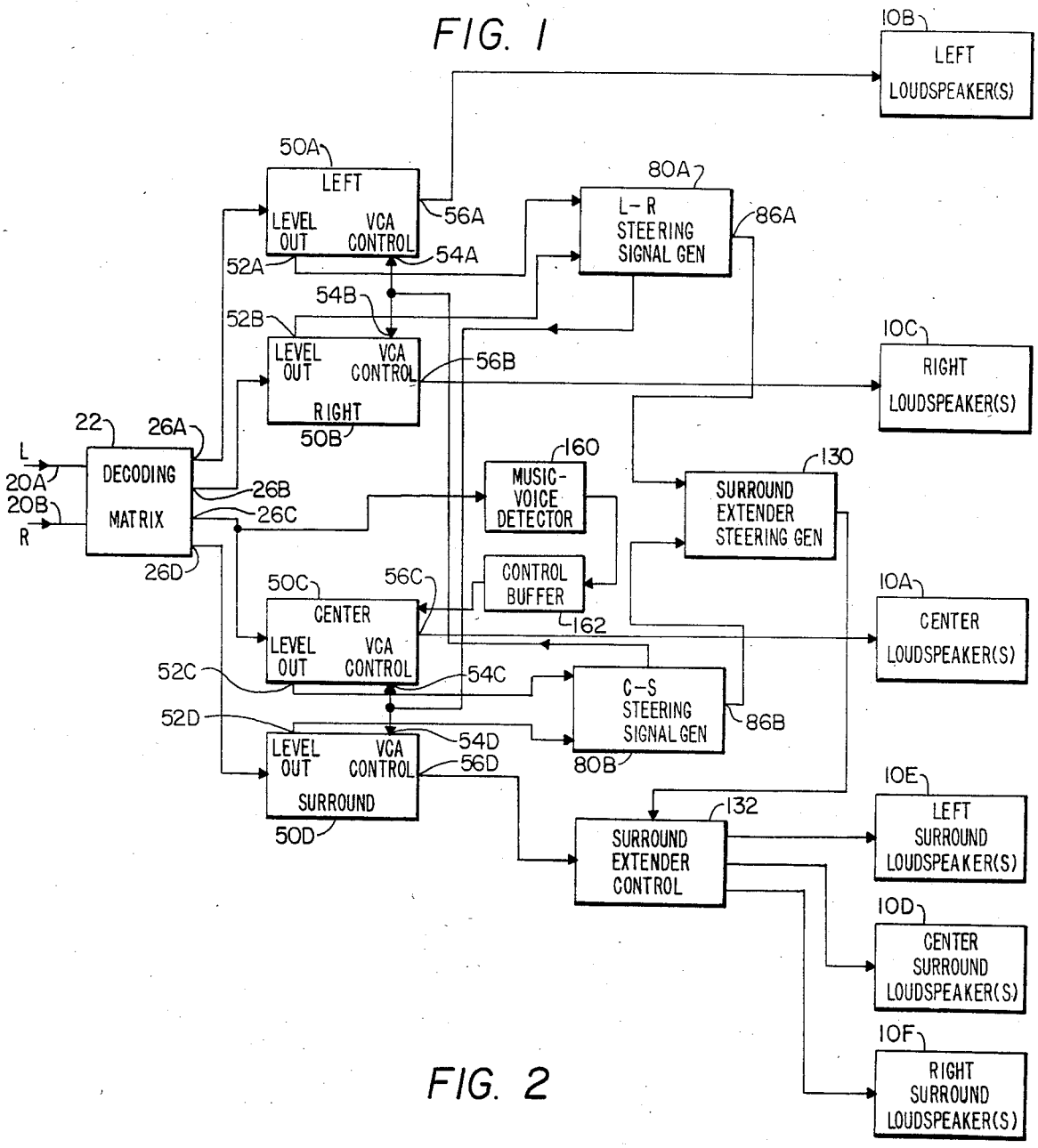
FIG. 2 is a block diagram of the preferred decoding system of the present invention.

A block diagram of the preferred embodiment of the decoding system of the present invention is shown in FIG. 2, wherein the input terminals 20A and 20B are respectively adapted to receive the two input signals. The signals may be received from any source, such as a phonograph record, an audio or video tape or disk, or from a motion picture sound track. The preferred embodiment is designed to be used with signals encoded in accordance with the split variable area (SVA) standard used in the motion picture industry. Generally, in accordance with the SVA standard, the left input signal contains the left (L) audio data, while the right input signal contains the right (R) audio data. The left input signal is used to drive the left speaker 10B, while the right input signal is used to drive the right speaker 10C. If both left and right input signals track in the same phase and are of the same amplitude (L+R), the combined signal is to be provided to the center speaker 10A. If both input signals are 180· out-of-phase (L−R), the difference signal is provided to the rear surround speakers 10D, 10E and 10F, all as previously described.

Figure 3:
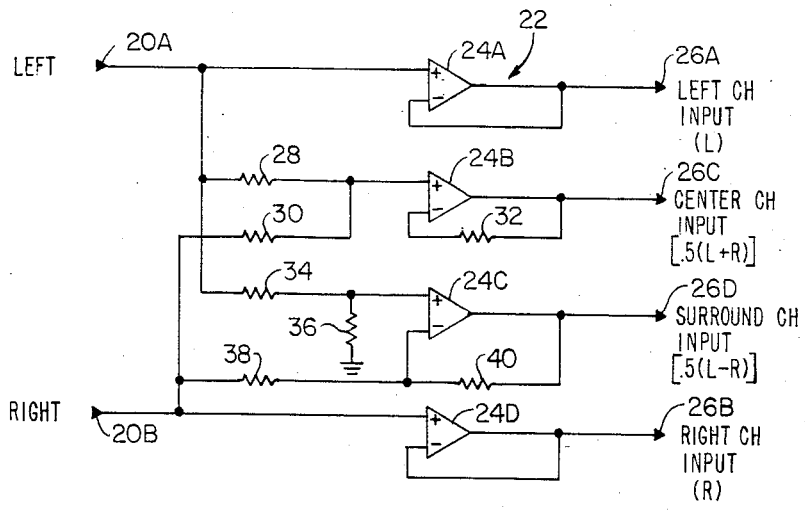
FIG. 3 is a partial schematic, partial block diagram of the preferred decoding matrix of the FIG. 2 embodiment.

The two input terminals 20A and 20B are accordingly connected to the decoding matrix 22 for generating the four distinct electrical information signals corresponding to the four groups of loudspeakers 10. The preferred decoding matrix 22 is shown in FIG. 3, wherein input 20A, receiving the left input signal, is connected to the non-inverting input of input buffer amplifier 24A, the latter having its output connected directly to its inverting input and forming the output terminal 26A of the decoding matrix for providing the left channel information signal (L). The input terminals 20A and 20B are connected through identical resistors 28 and 30 to the non-inverting input of buffer amplifier 24B so that the sum L+R is provided at this input. The latter amplifier 24B has its output connected through resistor 32 (having an identical value as resistors 28 and 30) so as to provide 0.5 gain. The output terminal 26C thus provides the preferred center channel information signal [0.5 (L+R)]. The input terminal 20A is also connected through resistor 34 to the non-inverting input of buffer amplifier 24C, the non-inverting input of amplifier 24C preferably being connected to system ground through resistor 36. Input terminal 20B is connected through resistor 38 to the inverting input of amplifier 24C, the latter having its output connected to its inverting input through resistor 40. Resistors 34 and 38 are of identical value (the same value as resistors 28 and 30), while resistors 36 and 40 are half the value of resistors 34 and 38 so that the output signal of amplifier 24C, provided to outer terminal 26D, is the preferred surround channel information signal [0.5 (L−R)]. Finally, the input terminal 20B is connected directly to the non-inverting input of buffer amplifier 24D with the output of the latter directly connected to its inverting input and directly to the output terminal 26B for providing the right channel signal (R).

Again referring to FIG. 2, the output terminals 26A, 26B, 26C and 26D of the decoding matrix 22 are respectively connected to the left, right, center and surround channel signal control units 50A, 50B, 50C and 50D. Generally, each control unit 50 includes at least one voltage control amplifier, set for expansion, and at least one level sensor adapted to sense the signal level output from the respective terminal 26 of the matrix 22 and for generating a control signal to the voltage control amplifier for controlling the signal gain impressed on the respective channel information signal. The signal gain provided on each channel information signal is thus a function of the signal level of the channel signal and will be expanded as a function of the signal level sensed. It should be appreciated that expansion is a technique wherein very low level input signals are attenuated while very large signals are amplified so as to increase the dynamic range of the channel information signal and increase the signal-to-ratio of the signal.

The preferred signal control unit is adapted to provide a DC signal output at terminal 52 representative of the value of the sensed signal level of the channel signal. The DC signal output is preferably a function of the RMS value of the sensed signal level within a mid-band frequency range, although other sensors are known, including those providing signals as a function of the average and the peak values of the sensed signal, and other frequency ranges can be used. Each unit 50 is also adapted to receive a steering signal at input terminal 54 as a function of the difference between the channel information signals in the diagonal pair of channels opposite to the pair in which the unit 50 is disposed. Finally, output terminal 56 provides the expanded output of the unit 50.

The preferred signal control unit 50 is a three-band expander employing voltage control amplifiers 60A, 60B and 60C, each preferably of the type described in U.S. Pat. No. 3,714,462 issued to David E. Blackmer on Jan. 30, 1973, and three RMS level detectors 62A, 62B and 62C each of the type described in U.S. Pat. No. 3,681,618 issued to David E. Blackmer on Aug. 1, 1972. Such a voltage control amplifier 60 will convert the portion of the channel signal received at its input to a first signal as a function of the logarithm of the input signal. The level sensor 62 provides a DC control signal as a function of the RMS level of the channel information signal. This DC control signal is summed with the log signal, with the summed signal being converted at the output of the voltage control amplifier 60 as a function of the antilogarithm of the summed signal. Such an expansion process is taught in U.S. Pat. No. 3,789,143 issued to David E. Blackmer on Jan. 29, 1974.

Figure 4:
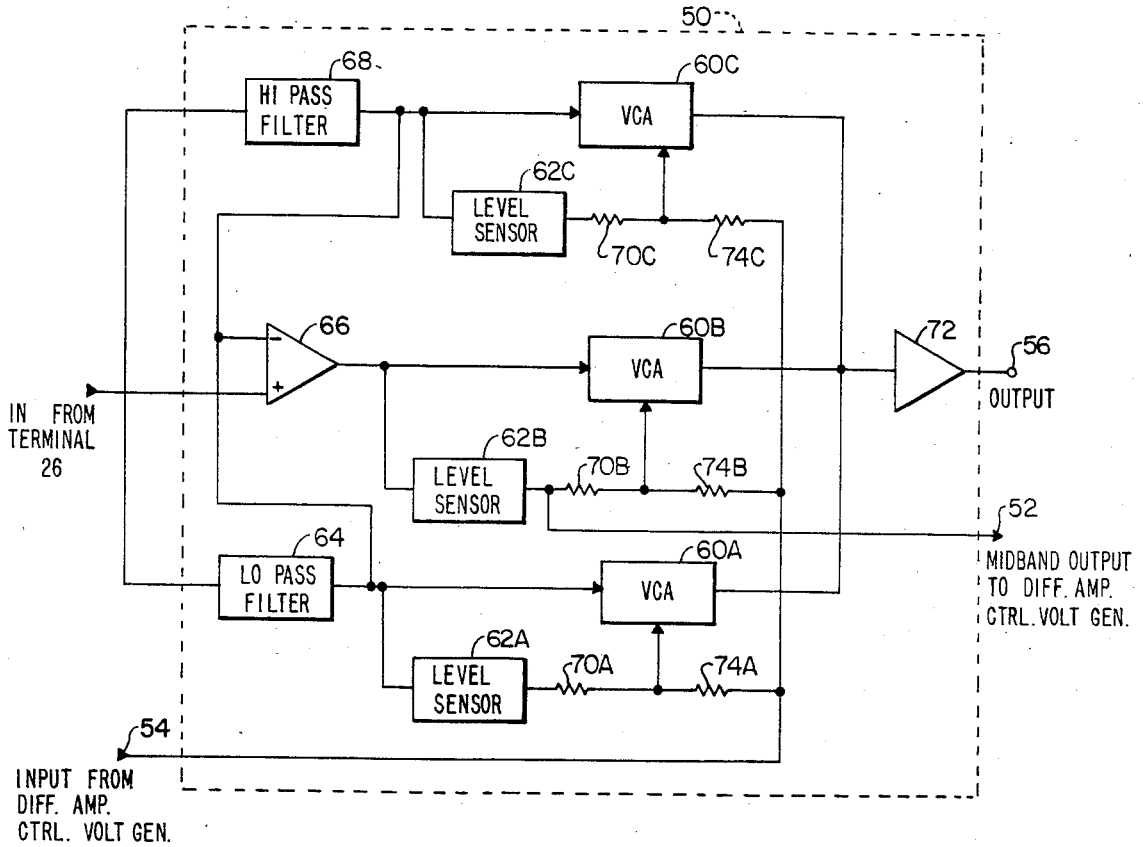
FIG. 4 is a partial schematic, partial block diagram of the preferred signal control unit for each quadraphonic information signal channel of the FIG. 2 embodiment.

More particularly, in FIG. 4, each terminal 26 is connected to a low pass filter 64, mid-band filter 66 and high pass filter 68. Preferably, low pass filter 64 passes substantially all signal energy from the channel signal below 100 Hz. High pass filter 68 passes substantially all signal energy from the channel signal above 1800 Hz. By using a differential amplifier for substracting the sum of the outputs from filters 64 and 68 from the input signal a mid-band filter 66 is provided for passing substantially all of the signal energy between 100 Hz and 1800 Hz. The output of low pass filter 64 is connected to the inputs of the voltage control amplifier 60A and level sensor 62A, the output of mid-band filter 66 is connected to the input of voltage control amplifier 60B and level sensor 62B and the output of high pass filter 68 is connected to the inputs of voltage control amplifier 60C and level sensor 62C. The output of each level sensor 62A, 62B and 62C is connected through a respective resistor 70A, 70B and 70C to the control signal input of the corresponding amplifier 60A, 60B and 60C. The value of each resistor 70 is set to provide a predetermined level of expansion. The expanded outputs for all three frequency bands are added together and applied to the input of summing amplifier 72. The channel signal is first divided into discrete frequency bands, each component expanded, and the expanded output combined to provide the expanded output signal at output terminal 56 of the unit 50.

As will be evident hereinafter, a steering signal derived from the difference between the two channel signals in the diagonal pair of channels, opposite to the diagonal pair in which the unit 50 is connected, is applied to terminal 54 where it is applied through each resistor 74A, 74B and 74C to the control signal provided from the respective level sensors 62A, 62B and 62C so as to effect the amount of expansion for each voltage control amplifier 60A, 60B and 60C. Additionally, the output of level sensor 62B representing the signal energy in the mid-band region of the channel signal is provided at the output terminal 52.

Referring again to FIG. 2, the output terminals 56A, 56B and 56C respectively providing the expanded left channnel, right channel and center channel information signals are connected to drive the power amplifiers of the corresponding left loudspeaker 10B, right loudspeaker 10C and center loudspeaker 10A. The output terminal 56D provides the expanded surround channel signal to the surround extender control unit 132, as described in greater detail hereinafter. The level output at each output terminal 52 of each unit 50 is connected to an input of a steering signal generator 80 for generating a steering signal applied to input terminals 54 of the amplifiers 50 for the opposite diagonal channels.

Figure 5A:
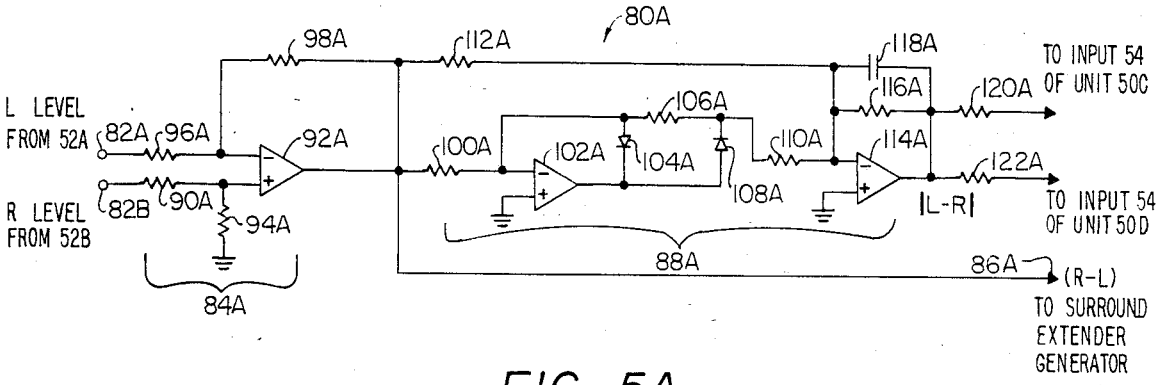
FIGS. 5A and 5B are, respectively, partial schematic, partial block diagrams of the preferred LR (left-right) and CS (center-surround) steering signal generators of the FIG. 2 embodiment.
Figure 5B:
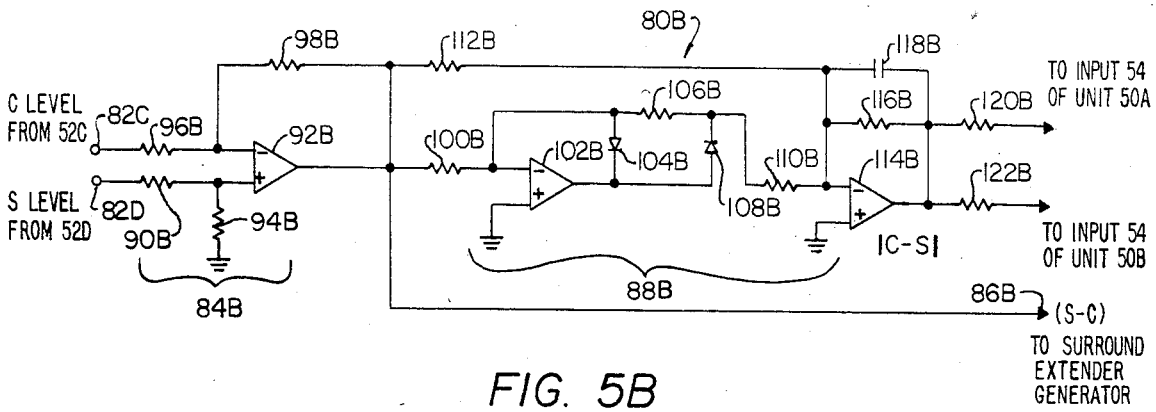

More specifically, each generator 80 is preferably a differential amplifier and control voltage generator of the type shown in FIGS. 5A and 5B. In FIG. 5A, the generator 80A includes two input terminals 82A and 82B for receiving the mid-band RMS level left (L) and right (R) sensor outputs from terminals 52A and 52B of units 50A and 50B (from level sensors 62B of those units). Since most signal information is typically contained in the mid-band range and most noise is typically outside this range a more accurate control is provided. The generator 80A is a two stage device. The first stage is a differential amplifier stage 84A for subtracting mid-band signal level provided at terminal 82A (the mid-band signal level of the left informatiom signal) from the signal level provided at terminal 82B (the mid-band signal level of the right information signal). This difference signal is provided at output terminal 86A to the surround extender, generator 130 to be described in greater detail hereinafter. The second stage 88A is an operational rectifier for providing the absolute value (one polarity only) of this difference signal. The output of stage 88A is applied through resistors of predetermined value so as to provide the steering signal for all of the amplifiers 60 of the center control signal unit 50A, and the steering signal for all of the amplifiers 60 of the surround control signal unit 50B.

Specifically, input terminal 82B of the generator 80A shown in FIG. 5A is connected through resistor 90 to the non-inverting input of a differential amplifier 92, while terminal 82A is connected through resistor 96 to the inverting input of amplifier 92 and the output of amplifier 92 is connected through feedback resistor 98 to its inverting input. The output of amplifier 92 forms the output of stage 84A, and provides one of the surround extender generator signals (R−L) at terminal 86A, as will be more apparent hereinafter.

The output of amplifier 92 is also connected through resistor 100 to the inverting input of amplifier 102 and to the anode of diode 104, the latter having its cathode connected to the output of the amplifier 102. The non-inverting input of amplifier 102 is connected to system ground, while output of the amplifier is connected to the anode of diode 108, the latter having its cathode connected through resistor 106 to the inverting input of the amplifier to form an operational rectifier. The junction formed by resistor 106 and diode 108 is connected (1) through resistor 110 to the feedback resistor 112, the latter being connected in turn to the output of amplifier 92 and (2) the inverting input of amplifier 114. Amplifier 114 has its non-inverting input connected to system ground and its output connected through each of resistor 116 and capacitor 118 to its inverting input. The resistor 116 and capacitor 118 have values set to provide a predetermined time constant as well-known in the art. The output of amplifier 114 is applied through resistor 120 to the steering control signal input 54 of center signal control unit 50C and through resistor 122 for the steering control signal input 54 of the surround signal control unit 50D.

The generator 80B of FIG. 5B is identical schematically to generator 80A except that resistors 120 and 122 of generator 80A are of equal value, while resistor 120 of generator 80B is equal to 1.5 times the value of resistor 122 of generator 80B, the latter resistor being equal in value to resistors 120 and 122 of generator 80A.

The input terminal 82C of generator 80B receives the mid-band RMS center (C) level signal from output terminal 52C of control signal unit 50C, while input terminal 82D of generator 80B receives the mid-band RMS surround (S) level signal from output terminal 52D of control signal unit 50D. The generator 80B provides the surround extender generator signal (S−C) at terminal 86B, and the absolute value signal output S−C for stage 88B. The latter signal is applied through resistors 120 and 122 of the generator 80B so as to provide the steering signal for all of the amplifiers 60 of the left control signal unit 50A and all of the amplifiers 60 of the right control signal unit 50B.

Referring again to FIG. 2, the output signals from terminals 86A and 86B of generators 80A and 80 respectively, are applied to the surround extender steering generator 130. The latter is adapted to provide a control signal to the surround extender control unit 132 for modifying the surround channel signal output from control signal unit 50D so as to enhance virtual sound images produced by the surround loudspeakers 10D, 10E and 10F.

Figure 6:
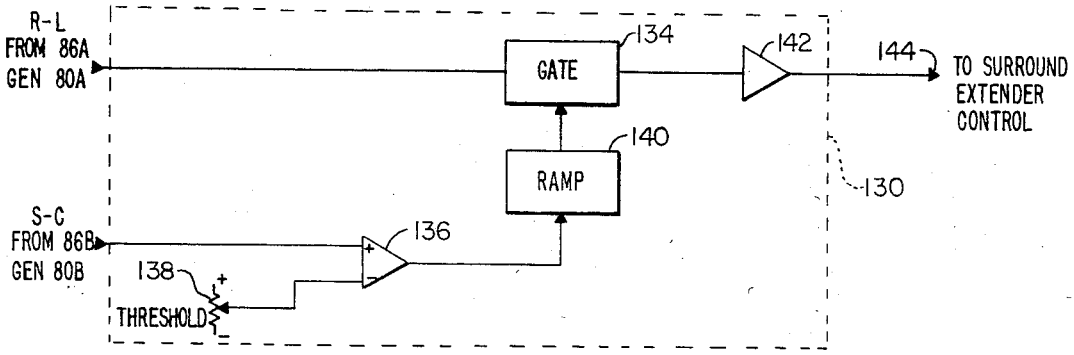
FIG. 6 is a block diagram of the preferred sound extender steering generator of the FIG. 2 embodiment.

More particularly, the preferred generator 130 is shown in FIG. 6. The R−L signal from terminal 86A of generator 80A is applied to the input of gate 134, while the S−C signal from terminal 86B of generator 80B is applied to the positive input of threshold detector 136. The negative input of detector 136 is connected to the top of an adjustable voltage source 138. The output of detector 136 is connected to ramp generator 140, which, in turn, is connected to the control input of gate 134. The output of gate 134 is connected to positive gain amplifier 142, the latter having its output terminal 144 connected to the surround extender control unit 132. Gate 134 can be any type of device (such as an FET transistor) for transmitting the R−L signal to amplifier 142, while the ramp generator 140 can be any type of device such as proportional voltage generator. When the S−C signal exceeds the threshold level set by source 138 detector 136 will provide an output signal to the ramp generator 140. The latter will in turn provide a signal to the gate 134 so that the latter becomes conductive. Thus, a signal is provided at the output terminal 144 when the mid-range frequency RMS level of the surround channel signal exceeds the mid-range frequency RMS level of the center channel signal by at least the threshold amount set by source 138 so as to transmit a control signal at output terminal 144 equal to the difference between the mid-range frequency RMS level of the right channel signal and the midrange frequency RMS level of the left channel signal.

Figure 7:
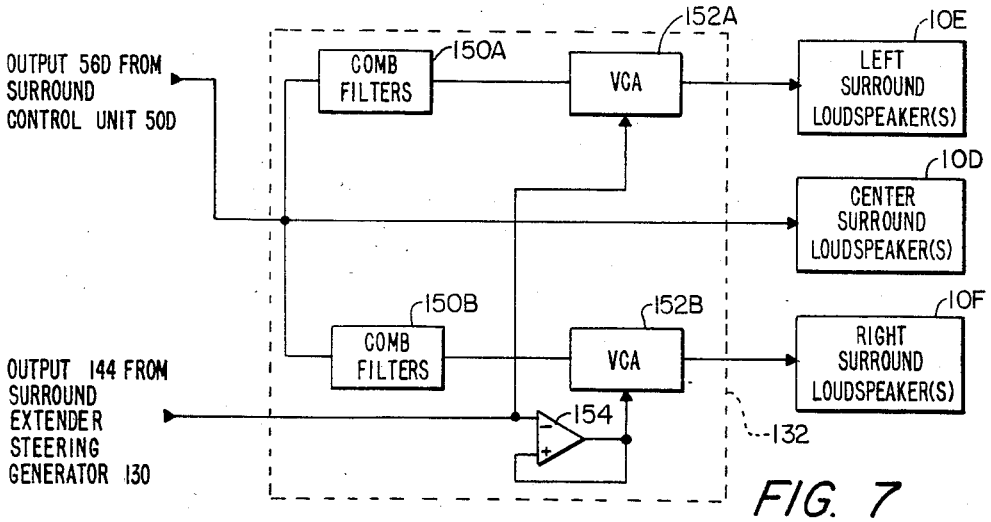
FIG. 7 is a block diagram of the surround extender control unit shown in the FIG. 2 embodiment.

The signal at output terminal 144 of generator 130 is applied to the control input of the surround extender control unit 132. The preferred unit 132 is shown in FIG. 7. As shown in FIG. 7, the output terminal 56D from unit 50D is connected directly to the power amplifier of loudspeaker 10D. This output is also connected to comb filters 150A and 150B which, in turn, have their respective outputs connected to the inputs of voltage control amplifiers 152A and 152B. The latter are set for expansion and preferably are identical to amplifiers 60 of units 50. The voltage output signal at terminal 144 of generator 130 is applied directly to the control input terminal of amplifier 152A, and through signal inverter 154 to the control input terminal of amplifier 152B. The expanded outputs of amplifier 152A and 152B are respectively applied to the left and right surround loudspeakers 10E and 10F.

The amount of expansion provided by amplifier 152A and 152B of FIG. 7 is preferably such that when the S−C signal of FIG. 6 exceeds the threshold (for example, +0.6 volts) set by source 138, a strong rear surround signal is present relative to the front center channel signal (provided to speaker 10A) and additional expansion is provided to the surround signal applied to the left and right surround signals. If the S−C signal exceeds the threshold and the R−L signal transmitted through gate 92 is positive (meaning a stronger signal to the right) the signal transmitted through amplifier 152B will be amplified providing a stronger signal to the right surround loudspeaker 10F, and the signal transmitted through amplifier 152A will be attenuated providing a weaker signal to the left surround loudspeaker 10E. This has the effect of enhancing the virtual sound image on the right side of the listener. Conversely, if the S−C signal exceeds the threshold and the R−L signal transmitted through gate 92 is negative (meaning a stronger signal to the left of the listener) the signal transmitted through amplifier 152A will be amplified providing a stronger signal to the left surround loudspeaker 10E, and the signal transmitted through amplifier 152B will be attenuated providing a weaker signal to the right surround loudspeaker 10F. This has the effect of enhancing the virtual sound image to the left of the listener. As will be readily evident to one skilled in the art, the comb filters 150A and 150B modify the signals transmitted therethrough to the left surround and right surround loudspeakers 10E and 10F so as to prevent sonic signals generated by these loudspeakers from creating a virtual image between them.

Amplifiers 152A and 152B are set for unity gain when the output of gate 134 is zero so that if the S−C signal is below the threshold level, or if above and the R−L signal is zero, there will be no change to the signals applied to loudspeaker 10E and 10F.

Finally, referring to FIG. 2, the output 26C of matrix 22, providing the L+R signal, is coupled to the input of a music-voice detector 160. The latter is of a type well-known in the art, and is preferably a level sensor of the type described in U.S. Pat. No. 4,404,427 issued to David E. Blackmer on Sept. 13, 1983. Generally, the level sensor described in this latter patent is adapted to distinguish information signals which quickly change, such as those associated with closed-miked speech, impulse noise, or staccato music and are adapted to be reproduced in a localized manner, from those associated with more slowly changing signals, such as those associated with background music and are adapted to be reproduced by loudspeakers connected to more than one channel. (See elements 50–110 in U.S. Pat. No. 4,404,427). In accordance with the present invention, the output of detector 160 is connected to the control buffer 162. The latter is adapted to reverse the polarity output of detector 160 and apply the resulting signal to a control input terminal of voltage control amplifier 60B (of FIG. 4) of the center channel signal control signal unit 50C. The advantage of utilizing detector 160 in this manner, and an advantage over the teachings of U.S. Pat. No. 4,404,427, is that the detector is being used for stereophonic presentation and utilizes the L+R stereo information in the center information channel to turn up the mid-range voltage control amplifier 60B of the center channel to turn up (i.e., amplify) those signals indicating localization in the center channel, such as closed-mike speech. Since background information produced on multiple channels is often more reverberant than localized information, turning up the amplifier 60B has the effect of amplifying these localized signals so as to improve the intelligibility of the localized information, such as speech, and improve the balance between localized information and the background information produced on multiple channels under adverse conditions.

The decoding system thus described, therefore, has the advantage of using the signal level in each channel for controlling the amount of expansion in each such channel and threeband expanders for each channel give more accurate control for producing the virtual sound images indicated by the audio data in the signals provided at the input terminals 20A and 20B, as well as increase the separation provided by matrix 22 by signal expansion. Mid-band frequency levels of the channel signals are used to provide the steering control signals since the mid-band frequency region of those signals typically include most of the program information and less noise. The surround extender steering generator 130 and surround extender control unit 132 provide enhanced steering of signals to one side of the listener or the other when the audio data of the channel signals indicates that a strong rear signal relative to the front center is present. As a result, this strong rear channel signal is used to enhance left or right virtual sound images.

Since certain changes may be made in the above apparatus without departing from the scope of the invention herein involved, it is intended that all matter contained in the above description or shown in the accompanying drawings shall be interpreted in an illustrative and not in a limiting sense.

What is claimed is:

1. A signal decoding system for generating at least four electrical information signals in response to two input signals for respectively driving at least four loudspeakers adapted to be positioned at different locations with respect to a listener, said signal decoding system comprising:

means responsive to said input signals for generating said four electrical information signals each with select audio data for repsectively driving said loudspeakers as a function of the position of the respective loudspeaker relative to the listener;

at least four electrical transmission paths for respectively transmitting the four information signals to and driving the corresponding ones of said loudspeakers;

means disposed in each of said transmission paths for impressing a signal gain on at least a portion of the information signal transmitted over each said path as a function of a corresponding control signal generated for said path; and means coupled to each of said transmission paths for detecting the signal level of the portion of the information signal transmitted over each said path and for generating the corresponding control signal for each said path in response to and as a function of (a) at least a part of the detected portion of the information signal for said path and (b) the difference between at least a part of the detected portion of each of at least two other information signals transmitted over two other of said paths.

2. A system according to claim 1, wherein said means for impressing a signal gain on at least a portion of the information signal comprises means disposed in each of said transmission paths for generating a plurality of component signals corresponding to the signal energy in a corresponding plurality of distinct frequency bands of said information signal and means for varying the signal gain impressed on each of said signal components as a function for a control signal derived from each said component signal; and said means for detecting said portion of said information signal comprises means for detecting the signal level of each of said signal components and for generating a control signal for each of said component signals as a function of the detected level of each said signal component.

3. A system according to claim 2, wherein said plurality of distinct frequency bands includes substantially all of the signal energy within the bandwidth of said two input signals.

4. A system according to claim 1, wherein said audio data is representative of virtual images of sound reproduceable by said loudspeakers when said loudspeakers are disposed relative to said listener in a predisposed pattern, said system further including means responsive to said four information signals for generating a steering signal as a function of said audio data and means for adding said steering signal to the control signal for one of said paths so that virtual images created to one side and rear of said listener when said loudspeakers are disposed in said predisposed pattern are enhanced.

5. A system according to claim 4, wherein said means for generating said steering control signal includes means for generating a first signal in response to a comparison between the signal energy in said input signals representative of the audio data relating to the virtual image created to one side of the listener to the signal energy in said input signals representative of the audio data relating to the virtual image created to the other side of the listener when said loudspeakers are predisposed in said predisposed pattern, means for generating a second signal in response to a comparison between the signal energy in said input signals representative of the audio data relating to the virtual image created to the rear of the listener to the signal energy in said input signals representative of the audio data relating to the virtual image created in the front of the listener when said loudspeakers are predisposed in said predisposed pattern, means for generating said steering control signal as a function of said first signal when said second signal indicates a clearly determined directionality and means for adding said steering control signal to said control signals of at least two of said transmission paths so as to modify said virtual images to the sides of said listener.

6. A system for decoding two input signals into at least two pairs of information signals for selectively driving at least two pairs of loudspeakers predisposed in a preselected pattern, wherein each loudspeaker of each pair is angularly disposed with respect to the listener between the loudspeaker of the other pair, said system comprising:

means for generating said information signals in response to said input signals so that said information signals contain audio data relating to virtual sound images that can be created when said information signals are used to respectively drive said two pairs of loudspeakers; and means for modifying only one of the information signals of one of said pair of information signals when the difference between at least a select portion of the signal energy levels of the other pair of information signals indicates a clearly defined directionality relative to said listener so as to enhance said virtual sound image defined by said directionality.

7. A system according to claim 6, wherein said one information signal of one pair of said information signals is the rear signal for driving at least two loudspeakers adapted to be positioned behind the listener on each side of the listener, the other pair of such information signals are the left and right signals for driving the other of said pair of loudspeakers adapted to be respectively positioned toward the right and left sides of the listener, and said clearly defined directionality is a function of at least a predetermined difference between said left and right signals, and said means for modifying said one information signal includes first and second transmission paths for repsectively transmitting said one information signal to said two loudspeakers adapted to be positioned behind the listener, and means disposed in each said path for enhancing the gain impressed on said information signal for driving the loudspeaker of said two loudspeaker adapted to be positioned toward said one side of the listener at which said virtual image is indicated by said clearly defined directionality and means for reducing the gain impressed on said information signal for driving the other of said two loudspeakers adapted to be positioned toward the other side of said listener.

8. A system according to claim 7, wherein said means for modifying said one information signal includes a comb filter disposed in each of first and second transmission paths so as to modify the signals transmitted through said paths in order to prevent sonic signals generated by said two loudspeakers adapted to be positioned behind the listener from creating a virtual image between them.

9. A system according to claim 8, wherein said means for enchaning and said means for reducing said information signal each includes a signal expander.

10. A system according to claim 9, wherein the other information signal of said one pair of information signals is the front signal for driving at least one loudspeaker positioned substantially in front of said listener and the information signals of the other pair are adapted to respectively drive at least two loudspeakers positioned toward the left and right of the listener, and said means for modifying said rear signal includes means for comparing the difference in energy levels of at least a portion of the right and left signals, means for comparing the difference in energy levels of at least a portion of the rear and front signals and means fdor generating a control signal to both of said signals expanders when said right and left signals are different and said rear signal exceeds said front signal by a predetermined amount.

11. A system according to claim 1, wherein said means for generating said four electrical information signals generates said signals as a function of the location of at least four loudspeakers angularly spaced around the listener so that said loudspeakers form at least two pairs of loudspeakers with each loudspeaker of each pair being angularly disposed between the other pair of loudspeakers, and wherein said means for detecting the signal level of the portion of the information signal transmitted over each said path generates said control signal for each said path in response to and as a function of (a) at least a part of the detected portion of the information signal for that path for driving the corresponding loudspeaker, and (b) the difference between at least a part of the detected portion of each of at least the two information signals transmitted over the paths for driving the corresponding loudspeakers of the other pair.

12. A system according to claim 11, wherein said means for generating said four electrical information signals generates said signals as a function of the location of at least four loudspeakers angularly spaced around the listener with one of said loudspeakers positioned in front of the listener, one of said loudspeakers positioned behind the listener and the other two of said loudspeakers respectively positioned toward the right and left of said listener.

* * * * *

UNITED STATES PATENT AND TRADEMARK OFFICE

CERTIFICATE OF CORRECTION

PATENT NO. : 4,589,129

DATED : May 13, 1986

INVENTOR(S) : David E. Blackmer et al.

It is certified that error appears in the above-identified patent and that said Letters Patent is hereby corrected as shown below:

Claim 1, column 10, line 40, "repsectively" should be -- respectively --;

Claim 8, column 12, line 13, "repsectively" should be -- respectively --;

Claim 8, column 12, line 18, "speaker" should be -- speakers --;

Claim 9, column 12, line 34, "enchaning" should be -- enhancing --;

Claim 10, column 12, line 47, "fdor" should be -- for --; and

Claim 10, column 12, line 48, "signals" should be -- signal --.

Signed and Sealed this

*Fifth* Day of *August 1986*

[SEAL]

*Attest:*

DONALD J. QUIGG

*Attesting Officer*

*Commissioner of Patents and Trademarks*